US009126415B2

(12) United States Patent
Sasaki

(10) Patent No.: US 9,126,415 B2
(45) Date of Patent: Sep. 8, 2015

(54) PRINT FLUID CARTRIDGE HAVING PRINT FLUID SUPPLY PORTION, AND PRINT FLUID SUPPLYING APPARATUS

(71) Applicant: Toyonori Sasaki, Anjo (JP)

(72) Inventor: Toyonori Sasaki, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/203,721

(22) Filed: Mar. 11, 2014

(65) Prior Publication Data

US 2014/0285590 A1 Sep. 25, 2014

(30) Foreign Application Priority Data

Mar. 22, 2013 (JP) ..... 2013-060699

(51) Int. Cl.
*B41J 2/175* (2006.01)

(52) U.S. Cl.
CPC ..... *B41J 2/17513* (2013.01); *B41J 2/17509* (2013.01); *B41J 2/17553* (2013.01)

(58) Field of Classification Search
USPC ..... 347/84, 85, 86, 87
See application file for complete search history.

(56) References Cited

U.S. PATENT DOCUMENTS

| | | | | |
|---|---|---|---|---|
| 6,000,788 | A | 12/1999 | Iida | |
| 6,193,364 | B1 | 2/2001 | Iida | |
| 6,550,901 | B2 | 4/2003 | Iida | |
| 6,554,412 | B1 * | 4/2003 | Seino et al. | 347/86 |
| 6,786,581 | B1 | 9/2004 | Shinada et al. | |
| 7,011,397 | B2 | 3/2006 | Miyazawa et al. | |
| 7,077,514 | B2 | 7/2006 | Inoue et al. | |
| 7,434,923 | B2 | 10/2008 | Miyazawa et al. | |
| 7,455,398 | B2 * | 11/2008 | Kanbe | 347/86 |
| 7,690,759 | B2 * | 4/2010 | Yamada | 347/36 |
| 7,722,174 | B2 * | 5/2010 | Kimura et al. | 347/86 |
| 7,794,067 | B2 | 9/2010 | Miyazawa et al. | |
| 8,038,278 | B2 * | 10/2011 | Takagi | 347/86 |
| 8,419,173 | B2 * | 4/2013 | Hayashi et al. | 347/85 |
| 9,004,654 | B2 | 4/2015 | Hayashi et al. | |
| 2001/0006396 | A1 | 7/2001 | Iida | |

(Continued)

FOREIGN PATENT DOCUMENTS

| | | | |
|---|---|---|---|
| CN | 1481996 | A | 3/2004 |
| CN | 1535833 | A | 10/2004 |

(Continued)

OTHER PUBLICATIONS

Jun. 2, 2015—(CN) Notification of First Office Action—App 201410109182.6.

*Primary Examiner* — Anh T. N. Vo
(74) *Attorney, Agent, or Firm* — Banner & Witcoff, Ltd.

(57) ABSTRACT

A print fluid cartridge has a print fluid supply portion integrally formed with a cartridge body and including a cylindrical side wall protruding outwardly from the cartridge body. At least a portion of a tubular member is disposed in the print fluid supply portion with a gap formed between the cylindrical side wall and a portion of the tubular member disposed in the print fluid supply portion. An elastic member is provided in the print fluid supply portion between a first end of the tubular member and a protruding-end wall of the print fluid supply portion, and is formed with a through-hole. A lid body is disposed in the tubular member to move between a first position and a second position. An urging member is disposed in the tubular member to urge the lid body in a direction toward the first position.

19 Claims, 10 Drawing Sheets

(56) References Cited

U.S. PATENT DOCUMENTS

| | | | |
|---|---|---|---|
| 2002/0060725 | A1 | 5/2002 | Shinada et al. |
| 2003/0058312 | A1 | 3/2003 | Iida |
| 2003/0058313 | A1 | 3/2003 | Iida |
| 2003/0146959 | A1 | 8/2003 | Iida |
| 2004/0051766 | A1 | 3/2004 | Miyazawa et al. |
| 2004/0196340 | A1 | 10/2004 | Inoue et al. |
| 2004/0233260 | A1 | 11/2004 | Shinada et al. |
| 2005/0231571 | A1 | 10/2005 | Miyazawa et al. |
| 2007/0030302 | A1 | 2/2007 | Yamada |
| 2008/0316287 | A1 | 12/2008 | Miyazawa et al. |
| 2009/0141104 | A1 | 6/2009 | Takagi |
| 2009/0213195 | A1 | 8/2009 | Albertin et al. |
| 2011/0254905 | A1 | 10/2011 | Hayashi et al. |
| 2013/0187996 | A1 | 7/2013 | Hayashi et al. |

FOREIGN PATENT DOCUMENTS

| | | | |
|---|---|---|---|
| CN | 1789002 | A | 6/2006 |
| CN | 1907718 | A | 2/2007 |
| CN | 101028763 | A | 9/2007 |
| CN | 102233739 | A | 11/2011 |
| EP | 1090767 | A2 | 4/2001 |
| JP | H08-174860 | A | 7/1996 |
| JP | 2001-113723 | A | 4/2001 |
| JP | 2004-314600 | A | 11/2004 |
| JP | 2009-023233 | A | 2/2009 |

* cited by examiner

PRINT FLUID CARTRIDGE HAVING PRINT FLUID SUPPLY PORTION, AND PRINT FLUID SUPPLYING APPARATUS

CROSS-REFERENCE TO RELATED APPLICATION

This application claims priority from Japanese Patent Application No. 2013-060699 filed Mar. 22, 2013. The entire content of this priority application is incorporated herein by reference.

TECHNICAL FIELD

The present invention relates to a print fluid cartridge and a print fluid supplying apparatus.

BACKGROUND

There is conventionally known an image recording apparatus for recording an image on a recording sheet by using ink. The image recording apparatus is provided with an ink jet type recording head. The recording head has nozzles and selectively ejects ink droplets from the nozzles onto a recording sheet. The ink droplets are attached on the recording sheet, thereby recording a desirable image on the recording sheet. The image recording apparatus has an accommodating section in which an ink cartridge is mountable. The ink cartridge stores therein ink to be supplied to the recording head.

The ink cartridge has an ink supply port. A packing is provided between a protruding end of the ink supply port and a cap. The packing is formed with a through-hole that penetrates the packing. A valve body is provided inside the ink supply port so as to be movable between a position where the valve body closes the through-hole and another position where the valve body opens the through-hole. The accommodating section is provided with an ink supply needle. When the ink supply needle enters the ink supply port via the through-hole and moves the valve body to the position where the valve body opens the through-hole, ink is supplied from the ink cartridge to the recording head.

SUMMARY

The packing is in close contact with both of the ink supply port and the cap, in order to prevent ink from leaking through paths other than the through-hole. With this configuration, however, it is difficult to prevent leakage of ink. That is, ink may possibly leak through paths other than the through-hole.

In view of the foregoing, an object of the present invention is to provide a print fluid cartridge having a print fluid supply portion and a print fluid supplying apparatus that can reliably restrain leakage of print fluid from the print fluid supply portion.

In order to attain the above and other objects, the invention provides a print fluid cartridge including: a cartridge body; a print fluid supply portion; a tubular member; an elastic member; a lid body; and an urging member. The cartridge body has a reservoir storing print fluid therein. The print fluid supply portion is integrally formed with the cartridge body, the print fluid supply portion including a cylindrical side wall protruding outwardly from the cartridge body in a prescribed direction, the cylindrical side wall having a base end and a protruding end opposite to each other in the prescribed direction, the cylindrical side wall defining therein an internal space of the print fluid supply portion, the print fluid supply portion being integrated with the cartridge body at the base end of the cylindrical side wall such that the inner space of the print fluid supply portion is in fluid communication with an inside of the reservoir, the print fluid supply portion further including a protruding-end wall disposed at the protruding end of the cylindrical side wall, the protruding-end wall extending inwardly from the cylindrical side wall in a direction intersecting with the prescribed direction, the protruding-end wall having an inner peripheral edge defining a protruding-end opening. At least a portion of the tubular member is disposed in the inner space of the print fluid supply portion with a gap being formed between an inner surface of the cylindrical side wall and an outer surface of a portion of the tubular member disposed in the inner space of the print fluid supply portion, the tubular member extending in the prescribed direction and having a first end and a second end opposite to each other in the prescribed direction, the first end being disposed nearer to the protruding-end wall than the second end to the protruding-end wall in the prescribed direction, the tubular member being opened at both of the first end and the second end. The elastic member is provided in the inner space of the print fluid supply portion, the elastic member being disposed between the first end of the tubular member and the protruding-end wall of the print fluid supply portion, the elastic member being formed with a through-hole through which the protruding-end opening is in fluid communication with an inside of the tubular member, the elastic member having an outer peripheral portion, the outer peripheral portion having a first surface and a second surface, the first surface facing in the prescribed direction and surrounding an entire periphery of the through-hole, the second surface facing in a direction opposite to the prescribed direction and surrounding the entire periphery of the through-hole, the first surface being in contact with a portion of the protruding-end wall that surrounds an entire periphery of the protruding-end opening, the second surface being in contact with the first end of the tubular member. The lid body is disposed in the inside of the tubular member and configured to move between a first position, at which the lid body closes the through-hole of the elastic member, and a second position, at which the lid body opens the through-hole of the elastic member, the first and second positions being separate from each other in the prescribed direction. The urging member is disposed in the inside of the tubular member and configured to urge the lid body in a direction toward the first position.

According to another aspect, the present invention provides a print fluid supplying apparatus including: a cartridge accommodating section; and a print fluid cartridge insertable to the cartridge accommodating section in a prescribed direction. The print fluid cartridge includes: a cartridge body; a print fluid supply portion; a tubular member; an elastic member; a lid body; and an urging member. The cartridge body has a reservoir storing print fluid therein. The print fluid supply portion is integrally formed with the cartridge body, the print fluid supply portion including a cylindrical side wall protruding outwardly from the cartridge body in the prescribed direction, the cylindrical side wall having a base end and a protruding end opposite to each other in the prescribed direction, the cylindrical side wall defining therein an internal space of the print fluid supply portion, the print fluid supply portion being integrated with the cartridge body at the base end of the cylindrical side wall such that the inner space of the print fluid supply portion is in fluid communication with an inside of the reservoir, the print fluid supply portion further including a protruding-end wall disposed at the protruding end of the cylindrical side wall, the protruding-end wall extending inwardly from the cylindrical side wall in a direction intersecting with the prescribed direction, the protruding-end wall having an inner peripheral edge defining a protruding-end opening. At least a portion of the tubular member is disposed in the inner space of the print fluid supply portion with a gap being formed between an inner surface of the cylindrical side wall and an outer surface of a portion of the tubular member disposed in the inner space of the print fluid supply portion, the tubular member extending in the prescribed direction and having a first end and a second end opposite to each other in the prescribed direction, the first end being disposed nearer to the protruding-end wall than the second end to the protruding-end wall in the prescribed direction, the tubular member being opened at both of the first end and the second end. An elastic member is provided in the inner space of the print fluid supply portion, the elastic member being disposed between the first end of the tubular member and the protruding-end wall of the print fluid supply portion, the elastic member being formed with a through-hole through which the protruding-end opening is in fluid communication with an inside of the tubular member, the elastic member having an outer peripheral portion, the outer peripheral portion having a first surface and a second surface, the first surface facing in the prescribed direction and surrounding an entire periphery of the through-hole, the second surface facing in a direction opposite to the prescribed direction and surrounding the entire periphery of the through-hole, the first surface being in contact with a portion of the protruding-end wall that surrounds an entire periphery of the protruding-end opening, the second surface being in contact with the first end of the tubular member. The lid body is disposed in the inside of the tubular member and configured to move between a first position, at which the lid body closes the through-hole of the elastic member, and a second position, at which the lid body opens the through-hole of the elastic member, the first and second positions being separate from each other in the prescribed direction. The urging member is disposed in the inside of the tubular member and configured to urge the lid body in a direction toward the first position. The cartridge accommodating section includes a print fluid supplying tube that is configured to enter the through-hole of the elastic member and press the lid body to allow print fluid in the reservoir to flow out of the print fluid cartridge, the print fluid supplying tube being configured to move the lid body from the first position to the second position against the urging force of the urging member.

According to still another aspect, the present invention provides a cartridge including: a main body; an ink supply portion; a tubular member; an elastic member; and a lid body. The main body has one end. The ink supply portion extends in a prescribed direction away from the one end. The ink supply portion includes: a cylindrical side wall extending in the prescribed direction and having a base end and a distal end opposite to each other in the prescribed direction, the base end of the cylindrical side wall being integrated with the one end of the main body, the cylindrical side wall defining therein an internal space of the ink supply portion; and a distal end wall provided on the distal end of the cylindrical side wall, the distal end wall facing in the prescribed direction and being formed with an opening that is in fluid communication with the internal space of the ink supply portion. At least a portion of the tubular member is disposed in the internal space of the ink supply portion, the tubular member extending in the prescribed direction and having a first end and a second end opposite to each other in the prescribed direction, the first end being disposed nearer to the distal end of the cylindrical side wall than the second end to the distal end of the cylindrical side wall in the prescribed direction, the first end of the tubular member being formed with an opening. The elastic member is disposed in the internal space of the ink supply portion at a position between the distal end wall and the first end of the tubular member, the elastic member being formed with a through-hole through which the opening of the distal end wall is in fluid communication with the opening of the first end of the tubular member. The lid body is configured to open and close the through-hole of the elastic member.

BRIEF DESCRIPTION OF THE DRAWINGS

The particular features and advantages of the invention as well as other objects will become apparent from the following description taken in connection with the accompanying drawings, in which:

FIGS. 2A and 2B are perspective views showing the outer configuration of an ink cartridge according to the embodiment, wherein FIG. 2A is for a state where films are welded to a frame in the ink cartridge, and FIG. 2B is an exploded perspective view of the ink cartridge, showing the frame and the films constituting the ink cartridge;

FIGS. 5A and 5B are cross-sectional views schematically showing the process how the ink cartridge is mounted in the cartridge accommodating section, wherein FIG. 5A shows the state before an ink needle is inserted into the ink supply portion, and FIG. 5B shows the state when insertion of the ink needle into the ink supply portion has been completed;

DETAILED DESCRIPTION

Figure 1:
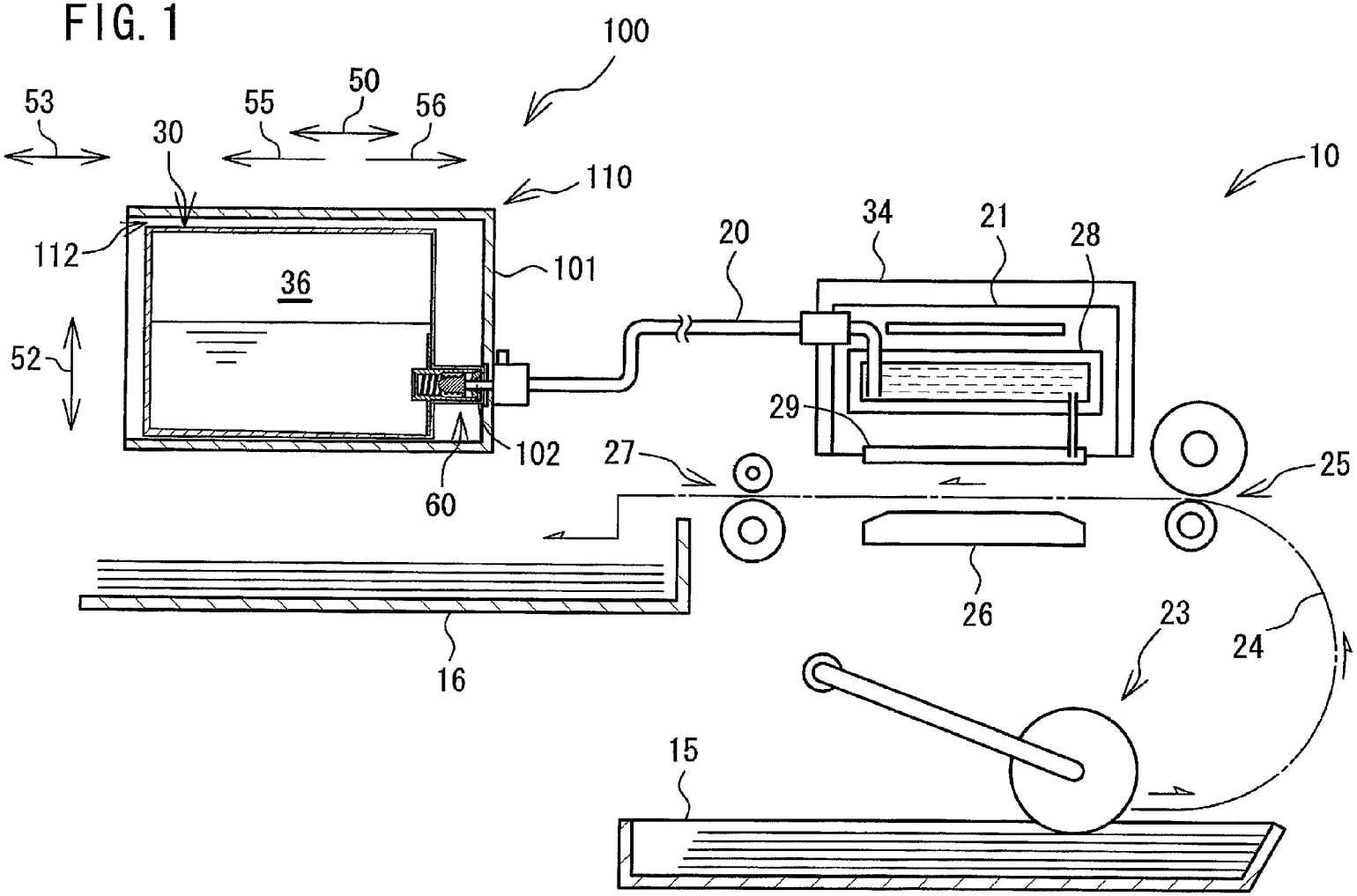
FIG. 1 is a cross-sectional view schematically showing the internal configuration of a printer provided with a cartridge accommodating section according to an embodiment of the present invention.

An ink cartridge 30 and a printer 10 according to an embodiment of the present invention will be described with reference to FIGS. 1 through 7.

[Overall Structure of Printer]

First, the printer 10 will be described with reference to FIG. 1. Hereinafter, the terms "upward", "downward", "upper", "lower", "above", "below", "beneath", "right", "left", "front", "rear" and the like will be used throughout the description assuming that the printer 10 and the ink cartridge 30 are disposed in an orientation in which they are intended to be used.

The printer 10 is configured to form an image by selectively ejecting ink droplets onto a sheet in accordance with an ink jet recording system. As shown in FIG. 1, the printer 10 includes: a recording head 21; an ink supply device 100 (as an example of a print fluid supplying apparatus); and an ink tube 20 connecting the recording head 21 and the ink supply device 100 to each other. The ink supply device 100 is for supplying ink to the recording head 21. More specifically, the ink supply device 100 is provided with a cartridge accommodating section 110 configured to detachably accommodate the ink cartridge 30 therein. The cartridge accommodating section 110 has one side formed with an opening 112. The ink cartridge 30 can be inserted into and removed from the cartridge accommodating section 110 through the opening 112.

The ink cartridge 30 (as an example of a print fluid cartridge and also as an example of a cartridge) accommodates therein ink (as an example of print fluid) usable in the printer 10. When the ink cartridge 30 is installed in the cartridge accommodating section 110, the ink cartridge 30 is connected to the recording head 21 through the ink tube 20. The recording head 21 has a sub tank 28 in which ink supplied through the ink tube 20 is temporarily stored. The recording head 21 also includes nozzles 29 through which ink supplied from the sub tank 28 is selectively ejected in accordance with the ink jet recording system.

The printer 10 also includes a sheet supply tray 15, a sheet supply roller 23, a sheet passage 24, a pair of conveyance rollers 25, a platen 26, a pair of discharge rollers 27, and a discharge tray 16 arranged in this order in a sheet feeding direction. The sheet supplied from the sheet supply tray 15 to the sheet passage 24 by the sheet supply roller 23 is conveyed to the platen 26 by the pair of conveyance rollers 25. Then, ink is selectively ejected from the recording head 21 onto the sheet passing on the platen 26 to form an ink image on the sheet. The sheet is then discharged onto the discharge tray 16 by the pair of discharge rollers 27.

[Ink Supplying Device]

As shown in FIG. 1, the cartridge accommodating section 110 has a casing 101 formed with the opening 112 and an ink needle 102 (as an example of a print fluid supplying tube). The ink cartridge 30 is loaded in and unloaded from the casing 101 through the opening 112. FIG. 1 shows the state where the ink cartridge 30 is fully mounted in the casing 101. It is noted that four ink cartridges 30 of cyan, magenta, yellow and black are loadable into four spaces formed in the cartridge accommodating section 110. However, for explanatory purpose, FIG. 1 shows only one internal space for accommodating one ink cartridge 30 therein.

As illustrated in FIG. 1, the ink cartridge 30 has an ink chamber 36 and an ink supply portion 60. As shown in FIG. 2A, the ink supply portion 60 has an opening 64. As shown in FIG. 3, an ink supply valve 70 having a lid body 80 to be described later is provided inside the ink supply portion 60 to open and close the opening 64. As shown in FIG. 1, the casing 101 has an end wall at a side opposite to the opening 112. The ink needle 102 is provided at a lower portion of the end wall of the casing 101. More specifically, the ink needle 102 is disposed at a position aligned with the ink supply portion 60 of the ink cartridge 30 when the ink cartridge 30 is mounted in the cartridge accommodating section 110. The ink needle 102 is a tubular resin needle. The ink needle 102 is connected to the ink tube 20. As will be described later in more detail, the ink needle 102 enters the ink supply portion 60 through the opening 64 and moves the lid body 80 of the ink supply valve 70 to open the opening 64. As a result, ink in the ink chamber 36 flows out of the ink cartridge 36 through the ink supply portion 60 and flows into the ink tube 20 via the ink needle 102.

[Ink Cartridge 30]

Figure 2B:
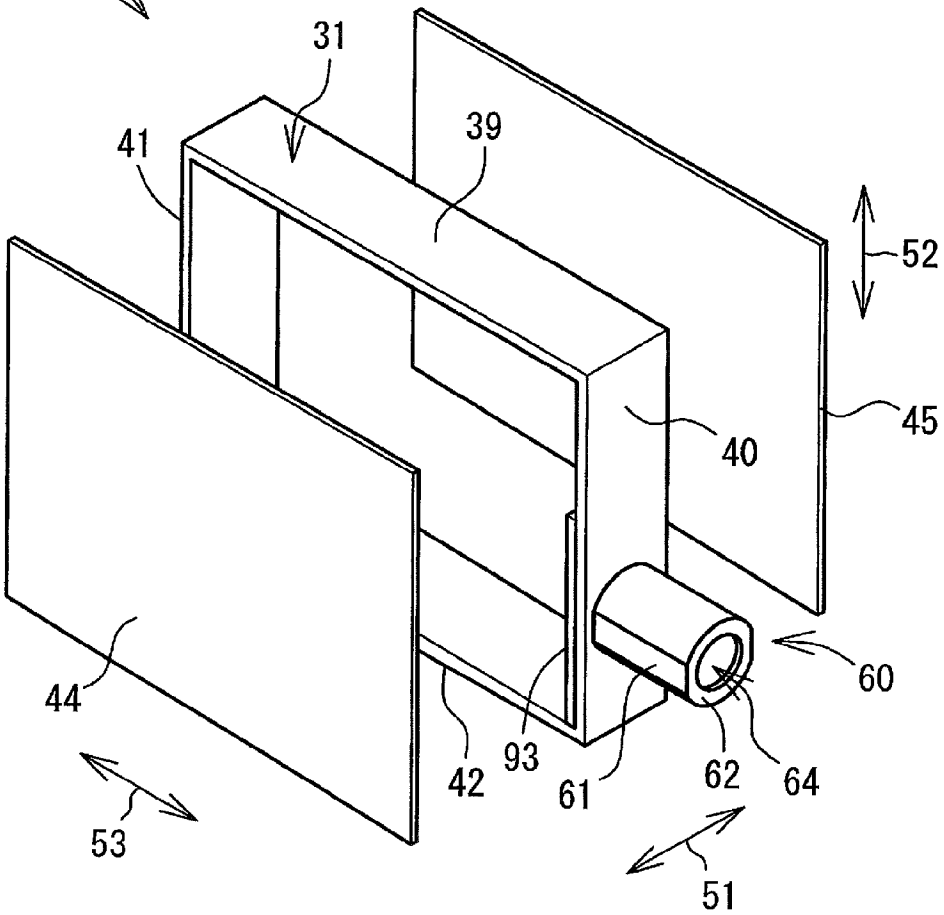
Figure 2A:
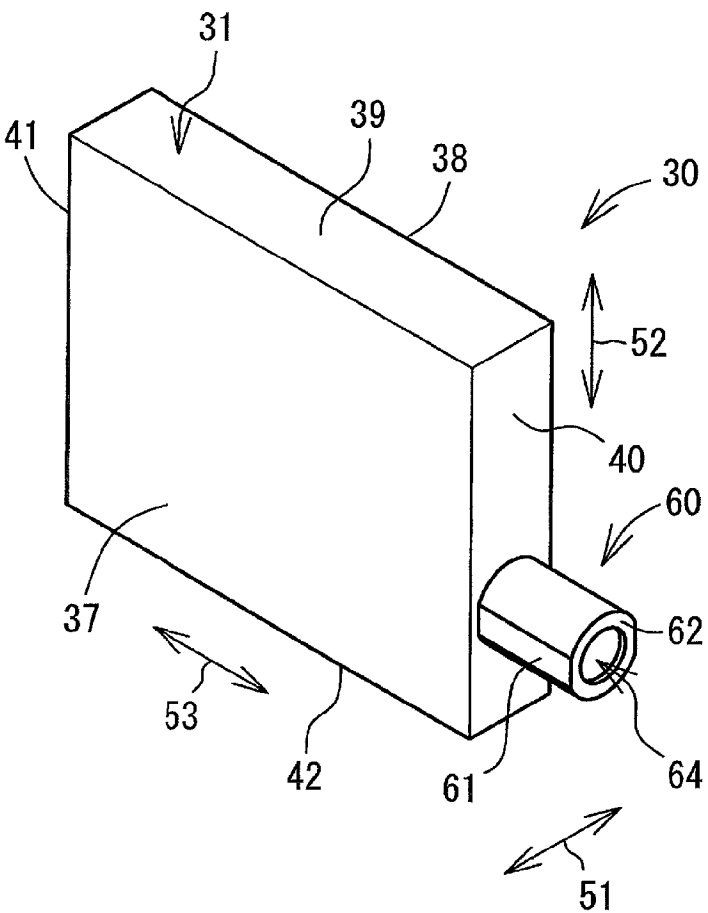
Figure 3:
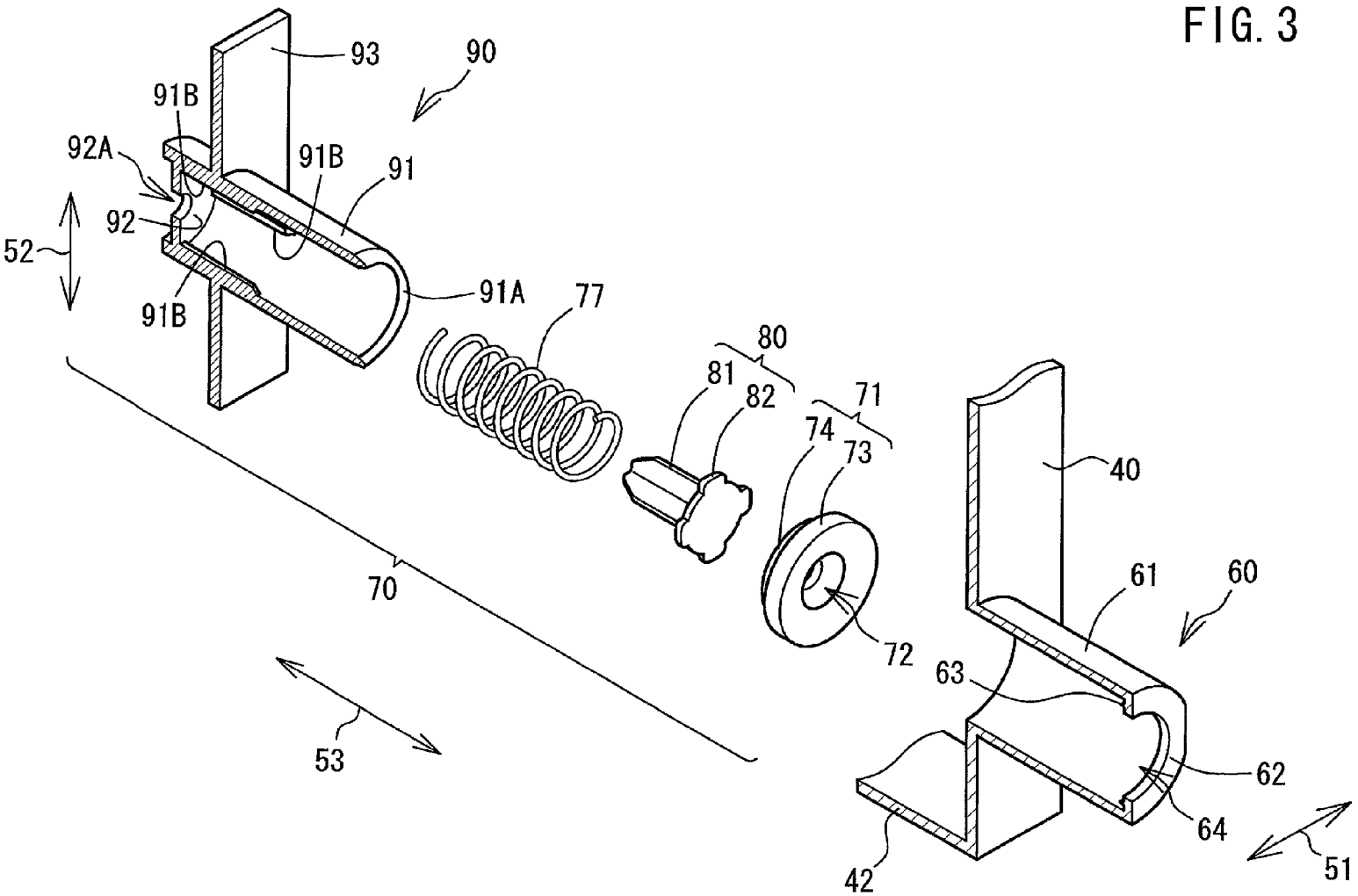
FIG. 3 is an exploded perspective view of an ink supply portion and an ink supply valve seen obliquely from the front, wherein a tubular member constituting the ink supply valve, and the ink supply portion are cut along a plane including both of a height direction and a depth direction.

As illustrated in FIGS. 2A and 2B, the ink cartridge 30 includes: a frame 31 (as an example of a cartridge body and also as an example of a main body) having the ink chamber 36 (as an example of a reservoir) therein; and the ink supply portion 60 (as an example of a print fluid supply portion and also as an example of an ink supply portion) that protrudes outwardly from the frame 31. The ink cartridge 30 is configured to supply ink stored in the ink camber 36 to an outside of the ink cartridge 30 through the ink supply portion 60.

The ink cartridge 30 is inserted into and removed from the cartridge accommodating section 110 in a standing posture illustrated in FIG. 2A. More specifically, as shown in FIG. 1, the ink cartridge 30 is inserted into and removed from the cartridge accommodating section 110 with a lower surface of the ink cartridge 30 facing down and an upper surface of the ink cartridge 30 facing up. The ink cartridge 30 is inserted into the cartridge accommodating section 110 in an insertion direction 56 (as an example of a prescribed direction) and is removed from the cartridge accommodating section 110 in a removal direction 55. Hereinafter, the insertion direction 56 and the removal direction 55 may be collectively referred to as an insertion/removal direction 50. A height direction 52 of the ink cartridge 30 in the standing posture corresponds to a direction of gravitational force.

As illustrated in FIG. 2B, the frame 31 has an outer shape of substantially a rectangular parallelepiped. More specifically, the frame 31 is in a flattened rectangular parallelepiped shape with its dimension in a width direction (left-right direction) 51 is relatively small and dimensions in the height direction (up-down direction) 52 and in a depth direction (front-rear direction) 53 are each larger than the dimension in the width direction 51. The frame 31 is configured of a front wall 40 and a rear wall 41 facing each other in the depth direction 53 and upper and lower walls 39 and 42 facing each other in the height direction 52. The upper wall 39 connects upper ends of the front wall 40 and rear wall 41. The lower wall 42 connects lower ends of the front wall 40 (as an example of a main wall and also as an example of one end) and rear wall 41. The front wall 40 is positioned at a front side in the insertion direction 56 (direction in which the ink cartridge 30 is inserted into the cartridge accommodating section 110) and the rear wall 41 is at a rear side in the insertion direction 56. In other words, the insertion/removal direction 50 illustrated in FIG. 1 coincides with the depth direction 53 illustrated in FIG. 2A.

As illustrated in FIG. 2B, the frame 31 is opened at its pair of opposite sides that are opposite in the width direction 51. The opened sides of the frame 31 are closed and sealed by films 44 and 45 (as an example of a film). The films 44 and 45 each have an outer shape substantially coincident with that of the frame 31 as viewed in the width direction 51. The films 44 and 45 are disposed on one side and the other side of the frame 31 in the width direction 51, respectively, to constitute both side walls of the ink chamber 36 in the width direction 51. That is, the film 44 serves as a left wall 37 of the ink cartridge 30 and film 45 serves as a right wall 38 of the ink cartridge 30 as shown in FIGS. 2A and 2B.

The films 44 and 45 are thermally welded to end faces of the frame 31 in the width direction 51, respectively. Thus, the films 44 and 45 are firmly attached to the frame 31. More specifically, the film 44 is thermally welded to left end faces of: the upper wall 39, front wall 40, rear wall 41, and lower wall 42. Similarly, the film 45 is thermally welded to right end faces of: the upper wall 39, front wall 40, rear wall 41, and lower wall 42. It is noted that the film 44 is thermally welded also to a left end face of a flange portion 93 to be described later, and the film 45 is thermally welded also to a right end face of the flange portion 93. With this configuration, the ink chamber 36 is defined by the upper wall 39, front wall 40, rear wall 41, lower wall 42, and films 44, 45. Ink can be stored in the ink chamber 36. A cover member may be disposed on the outside the films 44 and 45 to prevent breakage of the films 44 and 45.

As illustrated in FIGS. 2, 3, 4, and 6, the ink supply portion 60 includes a cylindrical side wall 61 and a protruding-end wall 62 (as an example of a protruding-end wall and also as an example of a distal end wall). The cylindrical side wall 61 protrudes from the front wall 40 of the frame 31 outwardly (forwardly) along the depth direction 53. The cylindrical side wall 61 has a base end (rear end) and a protruding end (front end) opposite to each other in the depth direction 53. The cylindrical side wall 61 defines therein an inner hollow space, which serves as the inner space of the ink supply portion 60. The protruding-end wall 62 is disposed at the protruding end (front end) of the cylindrical side wall 61. The protruding-end wall 62 extends from an inner surface of the cylindrical side wall 61 radially inwardly in a direction intersecting the depth direction 53 (as an example of a direction intersecting with the prescribed direction). In the present embodiment, the protruding-end wall 62 extends in a direction orthogonal to the depth direction 53, that is, the radial direction of the cylindrical side wall 61.

In the present embodiment, the ink supply portion 60 is formed integrally with the frame 31. In other words, the cylindrical side wall 61 is integrated with the front wall 40 at the base end (rear end) of the cylindrical side wall 61 such that the inner space of the cylindrical side wall 61 is in fluid communication with the inside of the frame 31 (i.e., the inside of the ink chamber 36). The cylindrical side wall 61 extends continuously from the base end to the protruding end of the cylindrical side wall 61. The cylindrical side wall 61 has no openings or cut portions that bring the inside of the ink supply portion 60 to fluidly communicate with the outside of the ink supply portion 60.

An opening 64 (as an example of a protruding-end opening and also as an example of an opening) is formed in the protruding-end wall 62 so as to penetrate the protruding-end wall 62 in a thickness direction (depth direction 53). In other words, the opening 64 is defined by an inner peripheral edge of the protruding-end wall 62. The inside of the ink supply portion 60 is in fluid communication with the outside of the ink cartridge 30 through the opening 64. As described above, the base end (rear end) of the cylindrical side wall 61 is integrated with the front wall 40 such that the inside of the ink supply portion 60 is in fluid communication with the inside of the ink chamber 36 at the base end (rear end) of the cylindrical side wall 61. Thus, the ink camber 36 is in fluid communication with the outside of the ink cartridge 30 through the ink supply portion 60.

Figure 4:
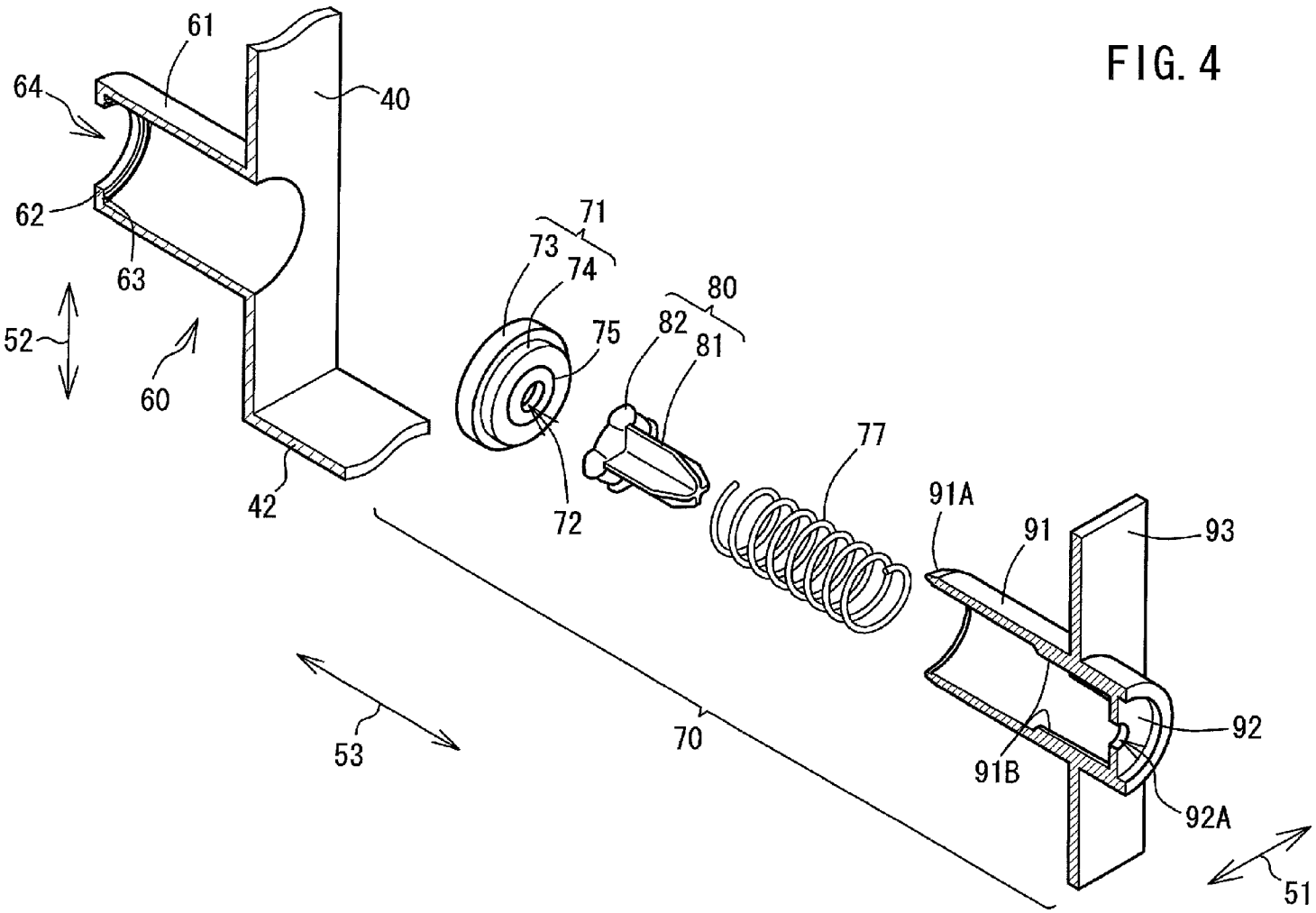
FIG. 4 is an exploded perspective view of the ink supply portion and the ink supply valve seen obliquely from the rear, wherein the tubular member constituting the ink supply valve, and the ink supply portion are cut along the plane including both of the height direction and the depth direction.
Figure 6:
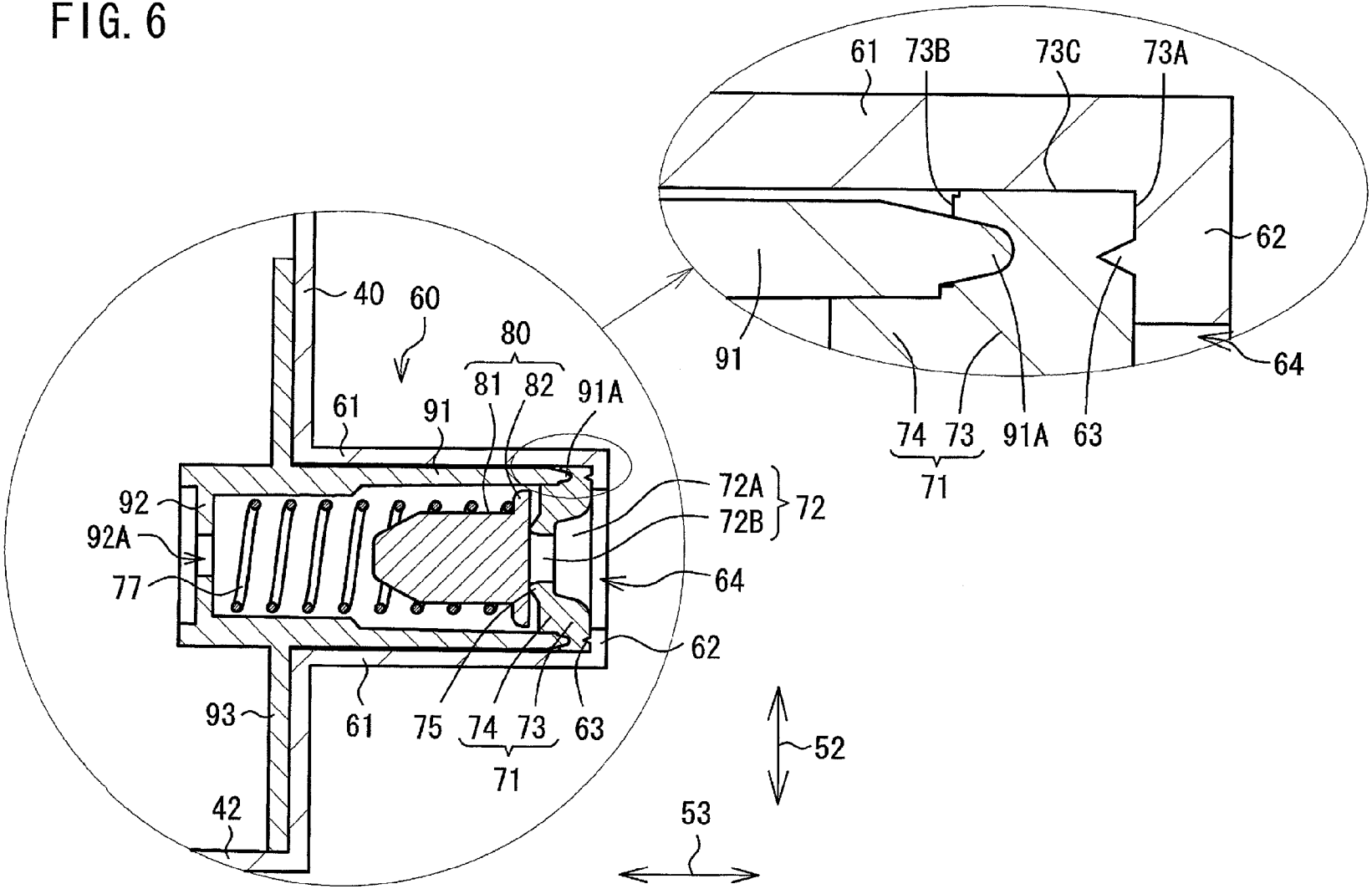
FIG. 6 is a cross-sectional view of the ink supply portion and the ink supply valve, showing the state of the ink supply valve in FIG. 5A.

As shown in FIGS. 4 and 6, a first annular ridge 63 is formed on an inner surface of the protruding-end wall 62 that faces the inside of the ink supply portion 60. The inner surface of the protruding-end wall 62 faces rearwardly in the depth direction 53. The first annular ridge 63 protrudes rearward in the depth direction 53. The first annular ridge 63 is an annular shape when viewed from the rear side in the depth direction, and surrounds or encloses the entire periphery of the opening 64.

In the present embodiment, as shown in FIG. 6, the first annular ridge 63 has a wedge shape in its cross section taken along a plane including the depth direction 53. That is, the first annular ridge 63 has a shape tapered gradually narrowed from its base end (front end) toward its protruding end (rear end).

As shown in FIGS. 3 and 4, in the inside of the ink supply portion 60, there are provided an elastic member 71, the lid body 80, a coil spring 77, and a tubular member 90 that constitute the ink supply valve 70. Before the films 44 and 45 are welded to the frame 31, these elements constituting the ink supply valve 70 are inserted into the ink supply portion 60 from the base end of the ink supply portion 60. The elements constituting the ink supply valve 70 are inserted into the ink supply portion 60 in the order of the elastic member 71, lid body 80, coil spring 77, and tubular member 90.

The ink supply valve 70 serves to open and close the opening 64 of the ink supply portion 60. Opening the opening 64 by the ink supply valve 70 allows ink to flow out of the ink chamber 36 to the outside of the ink cartridge 30 through the ink supply portion 60. On the other hand, closing the opening 64 by the ink supply valve 70 stops flow-out of ink through the ink supply portion 60. A status of the ink supply valve 70 (open or closed state of the opening 64) can be switched by insertion and removal of the ink needle 102 into and from the ink supply portion 60.

In the ink supply portion 60, the tubular member 90 is disposed at the rearmost position among all the elements constituting the ink supply valve 70 in the depth direction 53. The tubular member 90 includes a cylindrical tubular portion 91, a rear-end side wall 92 (as an example of a second-end side wall), and the flange portion 93. The tubular portion 91 extends in the depth direction 53, and are opened at both of its front end 91A and its rear end in the depth direction 53. As shown in FIG. 6, a front side part of the tubular portion 91 including the front end 91A is disposed in the inside of the ink supply portion 60. A rear side part of the tubular portion 91, which includes the rear end of the tubular portion 91 and which is disposed to the rear side of the front side part of the tubular portion 91 in the depth direction 53, is disposed not in the inside of the ink supply portion 60 but in the inside of the frame 31, that is, in the inside of the ink chamber 36. In other words, the rear side part of the tubular portion 91 protrudes into the inside of the frame 31 (i.e., the inside of the ink chamber 36).

The rear-end side wall 92 is disposed at a position of the tubular portion 90 close to the rear end of the tubular portion 90. The rear-end side wall 92 extends radially inwardly from the inner surface of the tubular portion 91.

A communication port 92A (as an example of a second-end side wall opening) is formed in the rear-end side wall 92 so as to penetrate the rear-end side wall 92 in a thickness direction (depth direction 53). In other words, the communication port 92A is defined by an inner peripheral edge of rear-end side wall 92. The inside of the tubular portion 91 is in fluid communication with the inside of the frame 31 through the communication port 92A.

The flange portion 93 is provided on the rear side part of the tubular portion 91 that is disposed in the inside of the frame 31 (i.e., the inside of the ink chamber 36). The flange portion 93 extends radially outwardly from the outer surface of the tubular portion 91.

A thickness of the tubular portion 91 (thickness in the radial direction) is gradually reduced toward the front end 91A. That is, the front end 91A of the tubular portion 91 has a tapered shape. An outer diameter of the tubular portion 91 is slightly smaller than an inner diameter of the cylindrical side wall 61 of the ink supply portion 60. Therefore, a gap is formed between an inner surface of the cylindrical side wall 61 and an outer surface of the portion of the tubular portion 91 that is disposed in the ink supply portion 60. An inner diameter of the tubular portion 91 is slightly larger than a diameter of the opening 64.

A plurality of ribs 91B are formed on an inner surface of the tubular portion 91. Each rib 91B protrudes radially inward from the inner surface of the tubular portion 91. Each rib 91B extends in the depth direction 53. The ribs 91B are disposed at a position that is nearer to the rear end of the tubular portion 91 than to the front end of the tubular portion 91 in the depth direction 53. In the present embodiment, four ribs 91B are provided in a circumferential direction of the tubular portion 91 at positions shifted in phase by 90 degrees from one another.

The tubular member 90 is fixed to the cartridge 30 by welding the flange portion 93 to: the inner surface (rear surface) of the front wall 40; and the films 44 and 45. It is noted that the flange portion 93 has a front surface facing the front wall 40. The entire area of the front surface of the flange portion 93 is welded to the inner surface of the front wall 40. Therefore, the gap between the outer surface of the tubular portion 91 and the inner surface of the cylindrical side wall 61 is sealed by the flange portion 93 at the base end of the cylindrical side wall 61. With this configuration, the inside of the frame 31 is in fluid communication with the inside of the ink supply portion 60 only through the communication port 92A.

In the ink supply portion 60, the elastic member 71 is disposed at the forward most position among all the elements constituting the ink supply valve 70 in the depth direction 53. The elastic member 71 is an elastic body whose outer shape is substantially in a disk shape. The elastic member 71 is disposed between the protruding-end wall 62 and the front end 91A of the tubular portion 91 in the depth direction 53. The elastic member 71 is in intimate contact with both of the ink supply portion 60 and the tubular member 90 to function as a sealing member (packing) for preventing ink from leaking through gaps between the elastic member 71 and the tubular member 90 and through gaps between the elastic member 71 and the ink supply portion 60. Examples of the material forming the elastic member 71 include: silicone rubber, ethylene propylene diene rubber (EPDM), and thermoplastic elastomer (TPE), although the material of the elastic member 71 is not limited to these examples.

As shown in FIGS. 3 and 4, the elastic member 71 includes a large diameter portion 73 and a small diameter portion 74. The large diameter portion 73 is larger in outer diameter than the small diameter portion 74. An outer diameter of the large diameter portion 73 is larger than the outer diameter of the tubular portion 91 but slightly smaller than the inner diameter of the cylindrical side wall 61. The outer diameter of the small diameter portion 74 is slightly larger than the inner diameter of the tubular portion 91.

A through-hole 72 is formed in the elastic member 71 so as to penetrate a radial center of the elastic member 71 in a thickness direction (i.e., depth direction 53) thereof. As illustrated in FIG. 6, the through-hole 72 includes a large diameter hole 72A penetrating the large diameter portion 73 and a small diameter hole 72B penetrating the small diameter portion 74. A diameter of the large diameter hole 72A is smaller than a diameter of the opening 64 but is larger than an outer diameter of the ink needle 102. On the other hand, a diameter of the small diameter hole 72B is slightly smaller than the outer diameter of the ink needle 102.

As shown in FIG. 6, the large diameter portion 73 includes: a first annular surface 73A; a second annular surface 73B; and an outer peripheral surface 73C. The first annular surface 73A faces forward in the depth direction 53 and therefore confronts the protruding-end wall 62. The first annular surface 73A is of an annular shape when viewed from the front side in the depth direction 53, and surrounds the entire periphery of the through-hole 72 (large-diameter hole 72A). The second annular surface 73B faces rearward in the depth direction 53 and therefore confronts the front end 91A of the tubular portion 91. The second annular surface 73B is of an annular shape when viewed from the rear side in the depth direction 53, and surrounds the entire periphery of the through-hole 72 (large-diameter hole 72A). The outer peripheral surface 73C extends continuously in the circumferential direction of the elastic member 71 at a position between the first annular surface 73A and the second annular surface 73B. The outer peripheral surface 73C faces radially outwardly and therefore confronts the inner surface of the cylindrical side wall 61.

As shown in FIGS. 4 and 6, a second annular ridge 75 is formed on a rear surface of the small diameter portion 74 that faces rearward in the depth direction 53. The second annular ridge 75 protrudes rearward in the depth direction 53. The second annular ridge 75 is in an annular shape when viewed from the rear side in the depth direction 53 and surrounds or encloses the entire periphery of the through-hole 72 (small diameter hole 72B).

As illustrated in FIG. 6, in a state where the ink supply valve 70 is assembled in the ink supply portion 60, the first annular surface 73A, second annular surface 73B, and outer peripheral surface 73C of the large diameter portion 73 are brought into pressure contact with the protruding-end wall 62, front end 91A of the tubular portion 91, and inner surface of the cylindrical side wall 61, respectively. More specifically, the first annular surface 73A is pressed against the protruding-end wall 62 at its area that surrounds the entire periphery of the opening 64 and that includes the first annular ridge 63. In this state, the wedge-shaped ridge 63 bites into the elastic member 71. Therefore, the first annular surface 73A and the protruding-end wall 62 contact with each other in a liquid-tight manner. The second annular surface 73B is pressed against the front end 91A of the tubular portion 91. The front end 91A of the tubular portion 91 extends continuously in the circumferential direction of the tubular portion 91 and therefore is of an annular shape when viewed from the front side in the depth direction 53. The front end 91A having the tapered shape bites into the elastic member 71. Therefore, the second annular surface 73B and tubular portion 91 contact with each other in a liquid-tight manner. The elastic member 71 is compressed by both of the protruding-end wall 62 and the front end 91A of the tubular portion 91 in the depth direction 53 to increase the diameter of the large diameter portion 73. Therefore, the outer peripheral surface 73C contacts with the inner surface of the cylindrical side wall 61 in a liquid-tight manner. The front end 91A of the tubular portion 91 and the first annular ridge 63 face each other in the depth direction 53, with the elastic member 71 being sandwiched therebetween. Therefore, the elastic member 71 can be compressed efficiently in the depth direction 53.

In a state where the ink supply valve 70 is assembled in the ink supply portion 60, the small diameter portion 74 of the elastic member 71 is positioned inside the tubular portion 91. The outer peripheral surface of the small diameter portion 74 is in contact with the inner surface of the tubular portion 91 in a liquid-tight manner.

As shown in FIGS. 3 and 4, the coil spring 77 (as an example of an urging member and also as an example of a spring) is disposed between the lid body 80 and tubular member 90 in the depth direction 53. A front end of the coil spring 77 is in abutment contact with the lid body 80, while a rear end of the coil spring 77 is in abutment contact with the rear-end side wall 92 at a position within an area of the rear-end side wall 92 that surrounds the entire periphery of the communication port 92A. The plurality of ribs 91B restrict the coil spring 77 from being displaced in the radial direction in the inside of the tubular member 90. The rear-end side wall 92 and plurality of ribs 91B therefore function as a spring seat for the coil spring 77. The coil spring 77 is held in a compressed state in the inside of the tubular member 90. The coil spring 77 therefore urges the lid body 80 in a direction toward the elastic member 71, that is, forward in the depth direction 53. The urging member used in the present invention is not limited to the coil spring 77, but may be a plate spring or a resin spring, for example.

As shown in FIGS. 3 and 4, the lid body 80 is disposed between the elastic member 71 and coil spring 77 in the depth direction 53. The lid body 80 is configured so as to be movable in the inside of the ink supply portion 60 in the depth direction 53. More specifically, the lid body 80 can move between a first position (position illustrated in FIG. 6) at which the lid body 80 is in contact with the elastic member 71 to close the through-hole 72 of the elastic member 71 and a second position (position illustrated in FIG. 7) at which the lid body 80 is separated away from the elastic member 71 to open the through-hole 72. By the lid body 80 closing the through-hole 72, the ink supply valve 70 closes the opening 64 of the ink supply portion 60. By the lid body 80 opening the through-hole 72, the ink supply valve 70 opens the opening 64. Examples of the material forming the lid body 80 include resin such as polyacetal (POM), polyethylene (PE), polypropylene (PP), although the material of the lid body 80 is not limited to these examples.

As shown in FIGS. 3 and 4, in the present embodiment, the lid body 80 includes a columnar portion 81 and a sealing portion 82. The sealing portion 82 is a member substantially of a disk shape which spreads radially outwardly from its radial center. An outer diameter of the sealing portion 82 is larger than the diameter of the small diameter hole 72B and is smaller than the inner diameter of the tubular portion 91.

The columnar portion 81 protrudes from substantially the radial center of the sealing portion 82 rearwardly in the depth direction 53. In other words, the sealing portion 82 is provided at the front end of the columnar portion 81. As shown in FIG. 6, the lid body 80 is disposed in the inside of the tubular member 90 such that the columnar portion 81 extends in the depth direction 53 and is inserted in the coil spring 77.

The disk-shaped sealing portion 82 has a front surface facing forwardly in the depth direction 53 and a rear surface facing rearwardly in the depth direction 53. In the present embodiment, as shown in FIGS. 3 and 6, the front surface of the sealing portion 82 is flat. The front surface of the sealing portion 82 can be brought into contact with the second annular ridge 75. The rear surface of the sealing portion 82 is in abutment contact with the front end of the coil spring 77.

As shown in FIGS. 3 and 4, corrugations are formed on the outer peripheral edge of the sealing portion 82 in the present embodiment. However, the outer peripheral edge of the sealing portion 82 may have any shape as long as the sealing portion 82 can contact the second annular ridge 75 over the entire length of the second annular ridge 75 in the circumference direction thereof.

In the present embodiment, as shown in FIG. 4, a cross section of the columnar portion 81 taken along a plane including both of the width direction 51 and the height direction 52 has a cross shape, although the shape of the columnar portion 81 is not limited to this example.

In a state where the lid body 80 is situated at the first position (position illustrated in FIG. 6), the sealing portion 82 is in contact with the second annular ridge 75 in a liquid tight state. Because the second annular ridge 75 surrounds or encloses the entire periphery of the through-hole 72 of the elastic member 71, the lid body 80 in contact with the second annular ridge 75 can close the through-hole 72. On the other hand, in a state where the lid body 80 is situated at the second position (position illustrated in FIG. 7), the sealing portion 82 is positioned separate away from the second annular ridge 75. Therefore, the lid body 80 opens the through-hole 72.

Next will be described with reference to FIGS. 5A to 7 how the ink supply valve 70 operates when the ink cartridge 30 is inserted into the cartridge accommodating section 110.

Figure 5A:
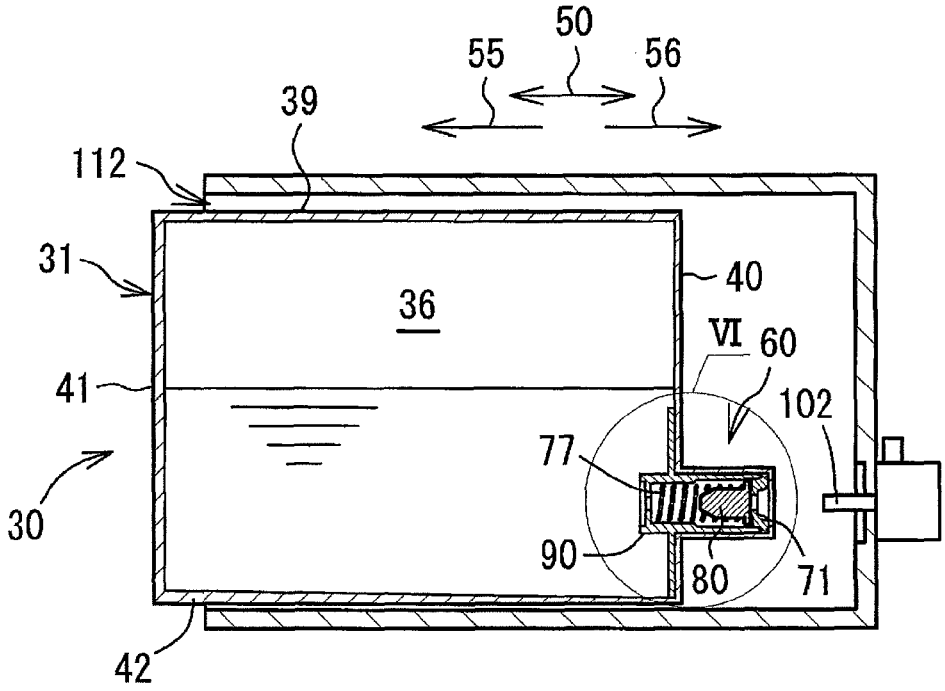

FIG. 5A illustrates a state before the ink needle 102 enters the opening 64 of the ink supply portion 60. At this point, as illustrated in FIG. 6, the ink supply valve 70 is in a state where the lid body 80 is situated at the first position. Specifically, the sealing portion 82 of the lid body 80 is in close contact with the second annular ridge 75 on the elastic member 71. The state illustrated in FIGS. 5A and 6 is therefore a state where the lid body 80 closes the through-hole 72 to prevent ink in the ink chamber 36 from flowing out of the ink cartridge 30 through the ink supply portion 60.

Figure 5B:
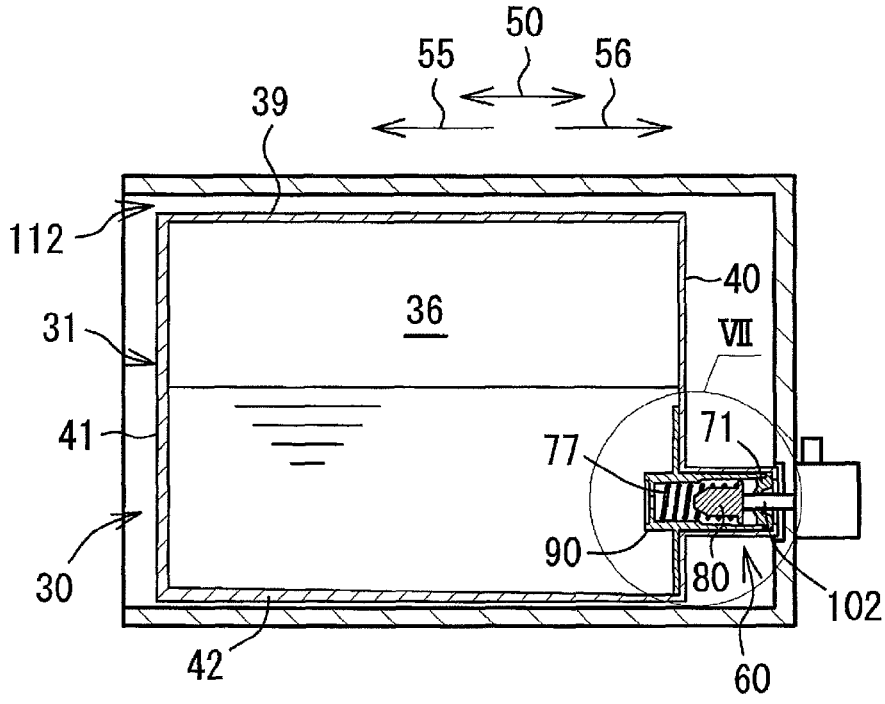
Figure 7:
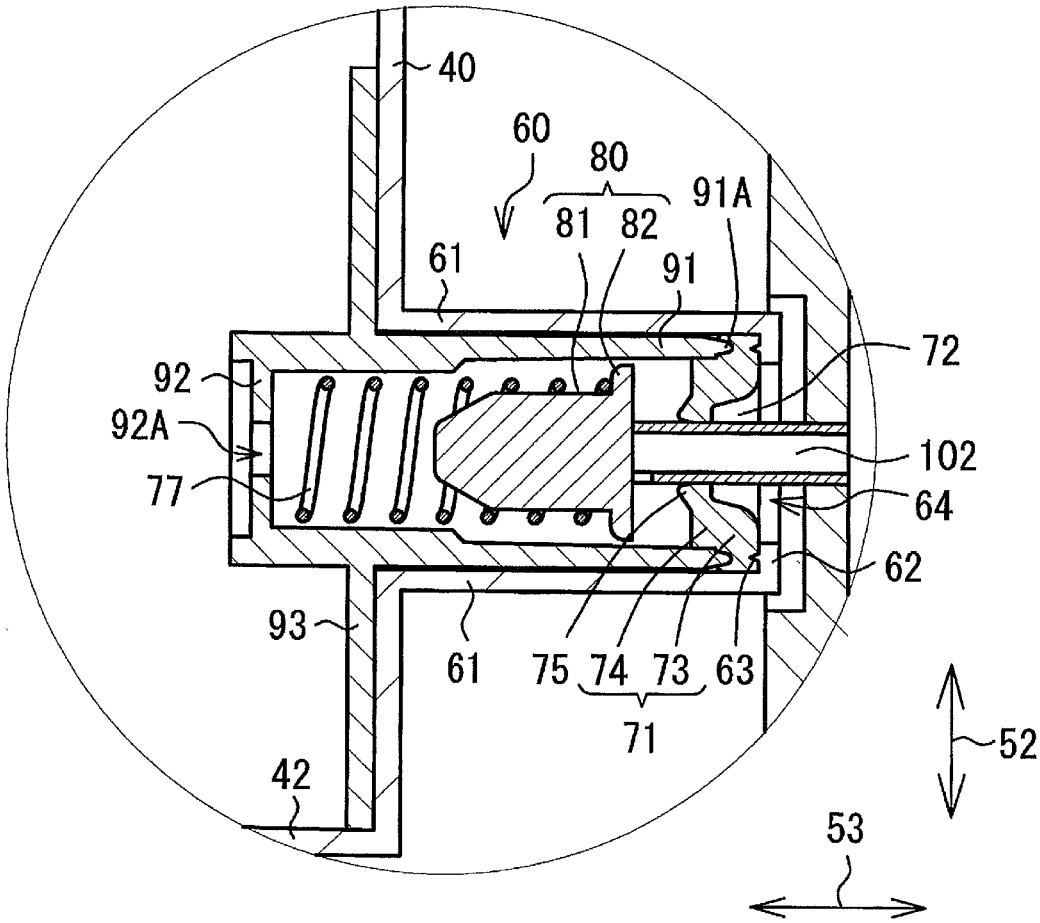
FIG. 7 is a cross-sectional view of the ink supply portion and the ink supply valve, showing the state of the ink supply valve in FIG. 5B.

FIG. 5B illustrates a state where the ink needle 102 that has passed through the opening 64 of the ink supply portion 60 and that has entered the through-hole 72 of the elastic member 71 pushes the lid body 80 to the rear side in the depth direction 53. At this point, as illustrated in FIG. 7, the ink supply valve 70 is in a state where the lid body 80 is situated at the second position. Specifically, the sealing portion 82 is positioned separate away from the second annular ridge 75 on the elastic member 71. The state illustrated in FIGS. 5B and 7 is therefore a state where the lid body 80 opens the through-hole 72 to allow ink in the ink chamber 36 to flow out of the ink cartridge 30 through the through-hole 72.

As described above, in the course of mounting the ink cartridge 30 to the cartridge accommodating section 110, the ink needle 102 that has entered the through-hole 72 moves the lid body 80 from the first position to the second position against the urging force of the coil spring 77. When the lid body 80 pushed by the ink needle 102 reaches the second position, ink in the ink chamber 36 is supplied to the recording head 21 through the ink supply portion 60, ink needle 102, and ink tube 20.

On the other hand, when the ink cartridge 30 is removed from the cartridge accommodating section 110, the lid body 80 moves from the second position back to the first position due to the biasing force of the coil spring 77. More specifically, as the ink needle 102 is gradually pulled out of the ink supply portion 60, the lid body 80 moves inside the ink supply portion 60 in a direction approaching the elastic member 71. The sealing portion 82 becomes close contact with the second annular ridge 75 when the lid body 80 reaches the first position illustrated in FIG. 6. At this point, flow-out of ink from the ink chamber 36 through the ink needle 102 is stopped.

[Functions of Present Embodiment]

According to the ink supply valve 70 having the configuration described above, the lid body 80 situated at the first position can prevent flow-out of ink through the through-hole 72. Other than the ink flowing path through the through-hole 72, there is a possible ink flowing path, through which ink may possibly flow out of the ink cartridge 30. This possible ink flowing path passes through: between the outer peripheral surface of the small diameter portion 74 and the inner surface of the tubular portion 91; between the second annular surface 73B of the large diameter portion 73 and the front end 91A of the tubular portion 91; between the outer peripheral surface 73C of the large diameter portion 73 and the inner surface of the cylindrical side wall 61; and between the first annular surface 73A of the large diameter portion 73 and the protruding-end wall 62.

According to the present embodiment, the ink supply portion 60, elastic member 71, and tubular member 90 are in contact with one another at their boundary surfaces in a liquid tight manner, so ink leakage through the above-described possible ink flowing path is prevented. The front end 91A of the tapered tubular portion 91 deeply bites into the elastic member 71, so ink leakage can be effectively prevented at this position. A large part of ink that has passed through between the front end 91A of the tubular portion 91 and the second annular surface 73B of the elastic member 71 is accommodated in the gap between the inner surface of the cylindrical side wall 61 and the outer surface of the portion of the tubular portion 91 disposed in the ink supply portion 60. This reduces the amount of ink that may possibly flow out of the ink cartridge 30 by passing through between the outer peripheral surface 73C of the elastic member 71 and the inner surface of the cylindrical side wall 61. In addition, the cylindrical side wall 61 is integrally formed with the frame 31 so as to protrude outwardly from the frame 31. Therefore, the base end side portion (rear side portion) of the cylindrical side wall 61 is provided with no ink flowing path, through which ink can flow out of the ink cartridge 30. Accordingly, even if ink that has flew into the gap between the outer surface of the tubular portion 91 and the inner surface of the cylindrical side wall 61 flows toward the base end side (rear side) of the cylindrical side wall 61, the ink does not flow out of the ink cartridge 30.

The wedge-shaped ridge 63 deeply bites into the elastic member 71, which effectively prevents flow-out of ink that has passed through between the outer peripheral surface 73C of the elastic member 71 and the inner surface of the cylindrical side wall 61.

The lid body 80 situated at the first position is urged by the coil spring 77 to press the elastic member 71 toward the protruding-end wall 62, causing the first annular surface 73A of the elastic member 71 to closely contact with the protruding-end wall 62. The combination of the above-described configurations can effectively prevent ink from flowing through the possible ink flowing path other than the path through the through-hole 72.

That is, if ink passes through between the second annular surface 73B and the front end 91A of the tubular portion 91, the ink flows into the gap between the inner surface of the cylindrical side wall 61 and the outer surface of the portion of the tubular portion 91 disposed in the ink supply portion 60. The amount of ink that is to flow in a direction toward the protruding-end wall 62 is reduced. Even if the small amount of ink flows toward the protruding-end wall 62 and passes through between the outer peripheral surface 73C of the elastic member 71 and the inner surface of the cylindrical side wall 61, the flow of ink is dammed up by the annular ridge 63 which deeply bites into the elastic member 71. Thus, leakage of ink from the ink cartridge 30 can be effectively prevented.

The outer peripheral surface 73C of the elastic member 71 may not be in close contact with the inner surface of the cylindrical side wall 61. However, closely contacting the elastic member 71 to the cylindrical side wall 61 can increase sealing property. Setting the outer diameter of the outer peripheral surface 73C smaller than the inner diameter of the cylindrical side wall 61 can make it easy to assemble the ink supply valve 70.

In the present embodiment, the first annular ridge 63 protrudes toward the inside of the ink supply portion 60 and is not exposed outside the ink cartridge 30. Therefore, the first annular ridge 63 is prevented from being damaged, before the ink cartridge 30 is assembled. The production yield of the ink cartridge 30 is improved. The cross sectional shape of the first annular ridge 63 is not limited to the wedge shape, but may be a rectangular shape or a trapezoidal shape, for example. Similarly, the shape of the front end 91A of the tubular portion 91 is not limited to the tapered shape.

In the present embodiment, the tubular member 90 is fixed to the frame 31, by the flange portion 93 being welded to the inner surface of the front wall 40 and to the films 44 and 45. This prevents the tubular member 90 from being displaced radially inside the cylindrical side wall 61, thereby restraining generation of a gap between the tubular member 90 and the elastic member 71. However, the method of fixing the tubular member 90 to the frame 31 is not limited to the above-described example.

For example, the flange portion 93 need not be welded to the inner surface of the front wall 40, but may be welded to the films 44 and 45 only. Preferably, in this case, the flange portion 93 may be welded to the films 44 and 45 in a state that the tubular member 90 is disposed relative to the ink supply portion 60 such that the flange portion 93 is positioned separate away from the inner surface of the front wall 40. This brings the gap between the inner surface of the cylindrical side wall 61 and the outer surface of the portion of the tubular member 90 disposed inside the ink supply portion 60 into fluid communication with the inside of the frame 31 (i.e., the inside of the ink chamber 36). Ink stored in the gap can flow back into the ink chamber 36. In other words, ink can be circulated between the gap and the ink chamber 36.

[First Modification]

Figure 8:
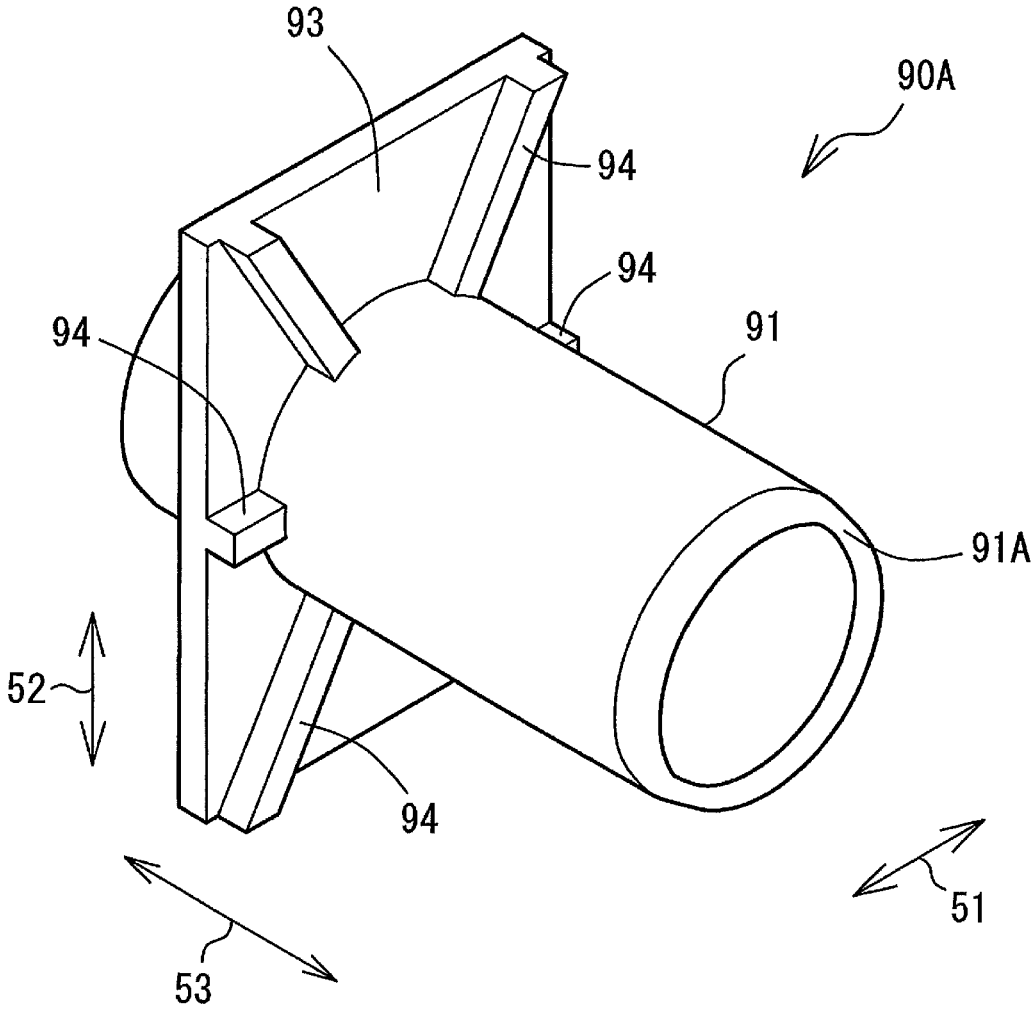
FIG. 8 is a perspective view of a tubular member according to a first modification.
Figure 9:
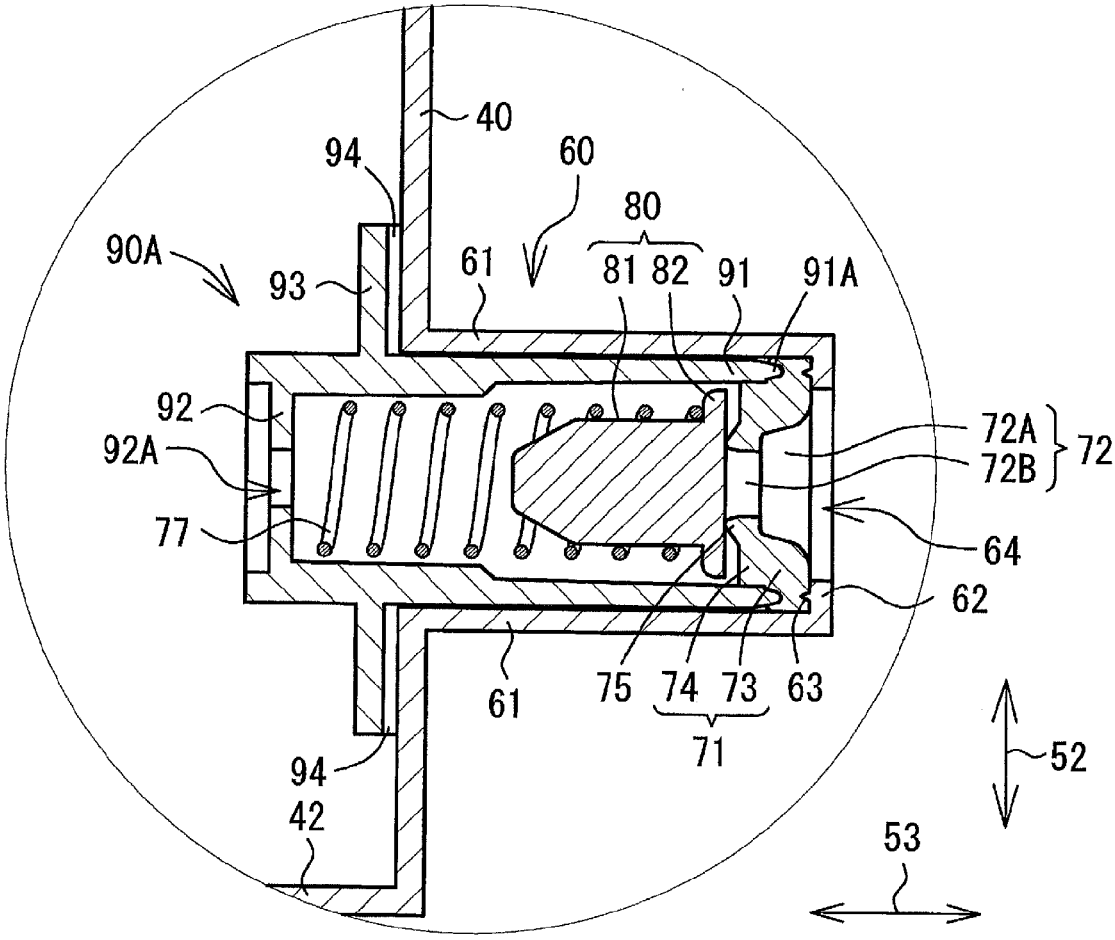
FIG. 9 is a cross-sectional view of an ink supply portion and an ink supply valve according to the first modification.

According to a first modification, a tubular member 90A shown in FIG. 8 may be employed in place of the tubular member 90 in the above-described embodiment. FIG. 9 shows how the tubular member 90A is attached to the ink supply portion 60. The same reference numerals are given to elements common to those of the embodiment, and detailed descriptions thereof are omitted, and only different points will mainly be described. The tubular member 90A in the first modification differs from the tubular member 90 of the embodiment in that the tubular member 90A includes a plurality of ribs 94 on the front surface of the flange portion 93 that faces forwardly in the depth direction 53 and therefore that confronts the front wall 40. The ribs 94 protrude from the front surface of the flange portion 93 forwardly in the depth direction 53, that is, toward the front wall 40. The ribs 94 are elongated to extend radially outwardly from the outer surface of the tubular portion 91.

In the first modification, the tubular member 90A is fixed to the frame 31 in such a manner that the left and right end surfaces of the flange portion 93 are welded to the films 44 and 45, respectively, and the protruding ends of the ribs 94 are welded to the inner surface of the front wall 40. As a result, the gap between the inner surface of the cylindrical side wall 61 and the outer surface of the portion of the tubular member 90A disposed in the ink supply portion 60 is brought into fluid communication with the inside of the frame 31 (the inside of the ink chamber 36) via the space on the areas of the front surface of the flange portion 93 where the ribs 94 are not formed. Further, by welding the ribs 94 to the front wall 40, the tubular member 90A can be fixed to the frame 31 more reliably as compared to the above-described modification in which the flange portion 93 is separate away from the front wall 40 and no part of the flange portion 93 is connected to the front wall 40.

Arrangement of the ribs 94 is not limited to the example shown in FIG. 8. For example, the ribs 94 may not extend radially outwardly. Further, the ribs 94 may not be of the elongated shape. Instead, a plurality of protrusions may be arranged discretely on the front surface of the flange portion 93. The protrusions may protrude forwardly in the depth direction 53, and the protruding ends of the protrusions may be welded to the inner surface of the front wall 40. Also with this configuration, the same effects as those obtained in the first modification illustrated in FIGS. 8 and 9 can be obtained.

[Second Modification]

Figure 10:
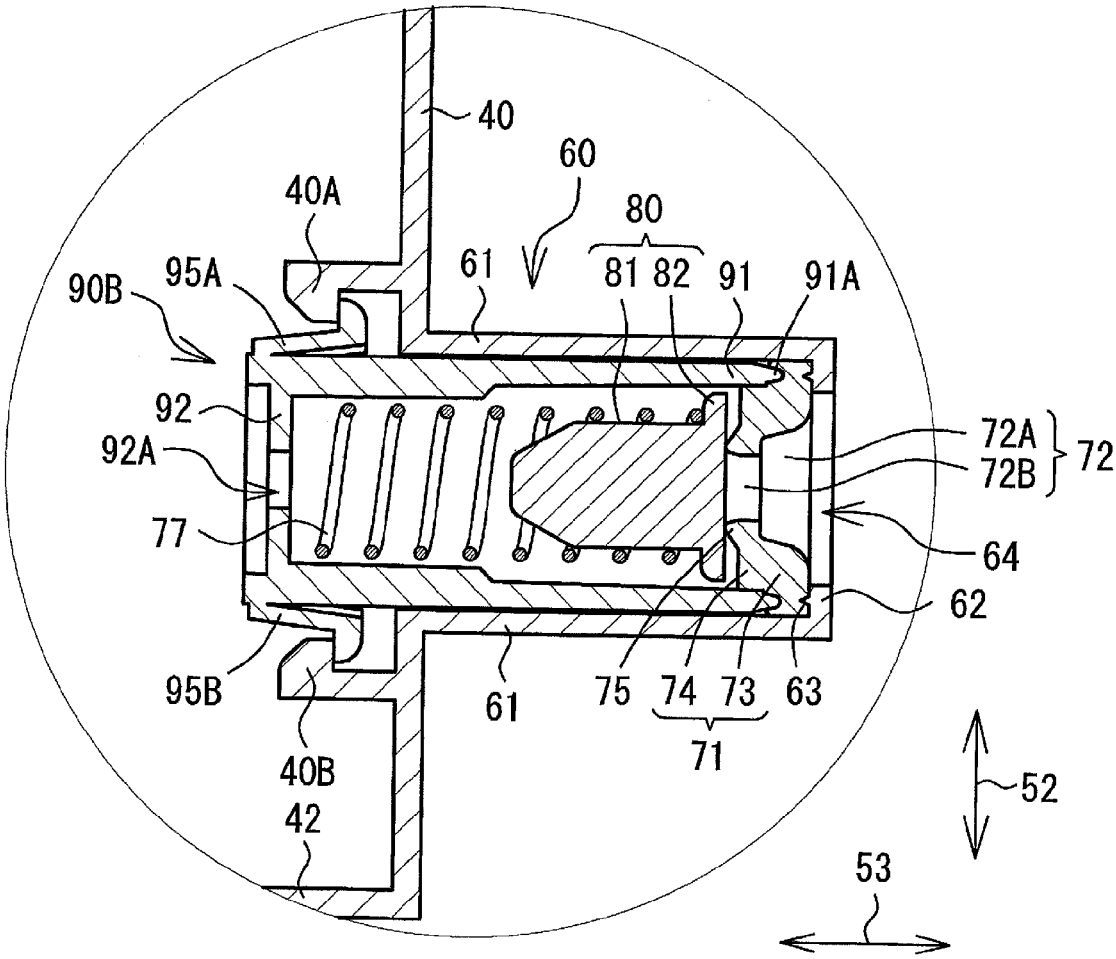
FIG. 10 is a cross-sectional view of an ink supply portion and an ink supply valve according to a second modification.

According to a second modification, a tubular member 90B shown in FIG. 10 may be employed in place of the tubular member 90 of the embodiment. The same reference numerals are given to elements common to those of the embodiment, and detailed descriptions thereof are omitted, and only different points will mainly be described. The tubular member 90B in the second modification differs from the tubular member 90 of the embodiment in that the tubular member 90B is provided with no flange portion 93, but is provided with engaged portions 95A and 95B.

The engaged portions 95A and 95B are disposed on the rear side part of the tubular portion 91 that is positioned in the inside of the frame 31. The engaged portions 95A and 95B are provided on the outer surface of the tubular portion 91. In the present modification, two engaged portions, that is, the engaged portions 95A and 95B are provided in the circumferential direction of the tubular portion 91 at positions shifted in phase by 180 degrees from each other. According to the second modification, engaging portions 40A and 40B are additionally provided on the inner surface of the front wall 40. The engaging portions 40A and 40B are disposed within an area of the inner surface of the front wall 40 that surrounds the entire periphery of the ink supply portion 60. The engaging portions 40A and 40B are disposed at positions corresponding to the engaged portions 95A and 95B.

With the above-described configuration, when the tubular member 90B is inserted into the ink supply portion 60, the engaged portions 95A and 95B are engaged with the engaging portion 40A and 40B, respectively. As a result, the tubular member 90B is fixed to the frame 31, with the gap between the inner surface of the cylindrical side wall 61 and the outer surface of the portion of the tubular member 90 disposed in the ink supply portion 60 being in fluid communication with the inside of the frame 31, i.e., the inside of the ink chamber 36. In the second modification, when fixing the tubular member 90B to the frame 31, no welding process is required, thereby making it easier to assemble the ink cartridge 30.

In the above-described embodiment and modifications, the ink supply portion 60 has a circular cross-section taken along a plane including the width direction 51 and height direction 52. However, the shape of the ink supply portion 60 is not limited to this example. Examples of the shape of the cross section of the ink supply portion 60 taken along the plane including the width direction 51 and height direction 52 include: a regular hexagon, a regular octagon, a regular dodecagon, and other regular polygons. Similarly, the shapes of the elastic member 71, lid body 80, and tubular member 90, 90A, or 90B to be inserted into the ink supply portion 60 are not limited to the above-described examples. That is, the shape of the cross sections of the elastic member 71, sealing portion 82 of the lid body 80, and tubular member 90, 90A, or 90B taken along the plane including the width direction 51 and height direction 52 may not be a circle, but may be a regular polygon such as a regular hexagon, a regular octagon, and a regular dodecagon.

In the above-described embodiment and modifications, the first annular ridge 63 is in an annular or circular shape when viewed from the rear side in the depth direction 53. However, the first annular ridge 63 may be modified into other shapes as long as the resultant, modified ridge 63 extends continuously around the entire opening 64 along a closed path that surrounds or encloses the entire periphery of the opening 64. For example, the modified ridge 63 may extend along a path that is in a regular polygonal shape (square shape, for example) when viewed from the rear side in the depth direction 53, the regular polygonal shape surrounding or enclosing the entire periphery of the opening 64.

Similarly, in the above-described embodiment and modifications, the second annular ridge 75 is in an annular or circular shape when viewed from the rear side in the depth direction 53. However, the second annular ridge 75 may be modified into other shapes as long as the resultant, modified ridge 75 extends continuously around the entire through-hole 72 along a closed path that surrounds or encloses the entire periphery of the through-hole 72. For example, the modified ridge 75 may extend along a path that is in a regular polygonal shape (square shape, for example) when viewed from the rear side in the depth direction 53, the regular polygonal shape surrounding or enclosing the entire periphery of the through-hole 72.

Further, the above-described embodiment and modifications are directed to an ink cartridge 30 that stores ink therein. However, the present invention is not limited to the ink cartridge. For example, the cartridge 30 may store pretreatment liquid that is ejected onto a recording medium before ink. In other words, the present invention may be applied to a print fluid cartridge that stores print fluid used for printing.

While the invention has been described in detail with reference to the embodiment and modifications thereof, it would be apparent to those skilled in the art that various changes and modifications may be made therein without departing from the spirit of the invention.

What is claimed is:

1. A print fluid cartridge comprising:

a cartridge body having a reservoir configured to store print fluid therein;

a print fluid supply portion integrally formed with the cartridge body, the print fluid supply portion including a cylindrical side wall protruding outwardly from the cartridge body in a prescribed direction, the cylindrical side wall having a base end and a protruding end opposite to each other in the prescribed direction, the cylindrical side wall defining therein an inner space of the print fluid supply portion, the print fluid supply portion being integrated with the cartridge body at the base end of the cylindrical side wall such that the inner space of the print fluid supply portion is in fluid communication with an inside of the reservoir, the print fluid supply portion further including a protruding-end wall disposed at the protruding end of the cylindrical side wall, the protruding-end wall extending inwardly from the cylindrical side wall in a direction intersecting with the prescribed direction, the protruding-end wall having an inner peripheral edge defining a protruding-end opening;

a tubular member, at least a portion of which is disposed in the inner space of the print fluid supply portion with a gap being formed between an inner surface of the cylindrical side wall and an outer surface of a portion of the tubular member disposed in the inner space of the print fluid supply portion, the tubular member extending in the prescribed direction and having a first end and a second end opposite to each other in the prescribed direction, the first end being disposed nearer to the protruding-end wall than the second end to the protruding-end wall in the prescribed direction, the tubular member being opened at both of the first end and the second end;

an elastic member provided in the inner space of the print fluid supply portion, the elastic member being disposed between the first end of the tubular member and the protruding-end wall of the print fluid supply portion, the elastic member being formed with a through-hole through which the protruding-end opening is in fluid communication with an inside of the tubular member, the elastic member having an outer peripheral portion, the outer peripheral portion having a first surface and a second surface, the first surface facing in the prescribed direction and surrounding an entire periphery of the through-hole, the second surface facing in a direction opposite to the prescribed direction and surrounding the entire periphery of the through-hole, the first surface being in contact with a portion of the protruding-end wall that surrounds an entire periphery of the protruding-end opening, the second surface being in contact with the first end of the tubular member;

a lid body disposed in the inside of the tubular member and configured to move between a first position, at which the lid body closes the through-hole of the elastic member, and a second position, at which the lid body opens the through-hole of the elastic member, the first and second positions being separate from each other in the prescribed direction; and an urging member disposed in the inside of the tubular member and configured to urge the lid body in a direction toward the first position.

2. The print fluid cartridge according to claim 1, wherein the protruding-end wall of the print fluid supply portion is provided with a ridge on a surface of the protruding-end wall facing the elastic member, the ridge protruding from the surface of the protruding-end wall in a direction toward the elastic member, the ridge extending continuously around the protruding-end opening along a closed path that surrounds an entire periphery of the protruding-end opening, the first surface of the elastic member being in contact with an area of the protruding-end wall within which the ridge is provided.

3. The print fluid cartridge according to claim 2, wherein the ridge on the protruding-end wall of the print fluid supply portion and the first end of the tubular member confront with each other in the prescribed direction with the elastic member being sandwiched therebetween.

4. The print fluid cartridge according to claim 2, wherein the ridge has a wedge-shaped cross section taken along a plane including the prescribed direction.

5. The print fluid cartridge according to claim 2, wherein a thickness of the tubular member is reduced toward the first end.

6. The print fluid cartridge according to claim 1, wherein the tubular member is provided with a second-end side wall at a position of the tubular member that is nearer to the second end than to the first end in the prescribed direction, the second-end side wall extending inwardly from the tubular member in a direction intersecting with the prescribed direction, the second-end side wall having an inner peripheral edge defining a second-end side wall opening, and wherein the urging member includes a coil spring, one end of the coil spring being in contact with the lid body and the other end of the coil spring being in contact with the second-end side wall at a position within an area of the second-end side wall that surrounds an entire periphery of the second-end side wall opening.

7. The print fluid cartridge according to claim 1, wherein:

the tubular member is provided with a flange portion at its portion disposed inside the reservoir, the flange portion extending outwardly from an outer surface of the tubular member in a direction intersecting with the prescribed direction, the cartridge body has a main wall from which the cylindrical side wall protrudes, and the flange portion is welded to an inner surface of the main wall.

8. The print fluid cartridge according to claim 1, wherein the gap between the inner surface of the cylindrical side wall and the outer surface of the portion of the tubular member disposed inside the print fluid supply portion is in fluid communication with an inside of the reservoir.

9. The print fluid cartridge according to claim 8, wherein:

the tubular member is provided with a flange portion at its portion disposed inside the reservoir, the flange portion extending outwardly from an outer surface of the tubular member in a direction intersecting with the prescribed direction, the flange portion is provided with a plurality of protrusions, the protrusions protruding from a surface of the flange portion that faces in the prescribed direction, the cartridge body has a main wall from which the cylindrical side wall protrudes, and protruding ends of the protrusions are welded to an inner surface of the main wall.

10. The print fluid cartridge according to claim 8, wherein:

the cartridge body has an outer wall from which the cylindrical side wall protrudes, the outer wall being opened at its pair of opposite sides that are opposite to each other in an intersecting direction intersecting with the prescribed direction, a film being provided to close the opened opposite sides of the outer wall, the tubular member is provided with a flange portion at its portion disposed inside the reservoir, the flange portion extending outwardly from an outer surface of the tubular member in the intersecting direction, and the flange portion is disposed at a position separated and away from an inner surface of the outer wall, and is welded to the film.

11. The print fluid cartridge according to claim 1, wherein:

a portion of the tubular member is disposed inside the reservoir, the cartridge body has a main wall from which the cylindrical side wall protrudes, the main wall is provided with an engaging portion on an inner surface of the main wall, and the tubular member is provided with an engaged portion that is engaged with the engaging portion.

12. The print fluid cartridge according to claim 1, wherein the outer peripheral portion of the elastic member further includes an outer peripheral surface that extends continuously in a circumferential direction of the elastic member at a position between the first surface and the second surface, the outer peripheral surface being in contact with the inner surface of the cylindrical side wall.

13. A print fluid supplying apparatus comprising:

a cartridge accommodating section; and a print fluid cartridge insertable to the cartridge accommodating section in a prescribed direction, the print fluid cartridge including:

a cartridge body having a reservoir configured to store print fluid therein;

a print fluid supply portion integrally formed with the cartridge body, the print fluid supply portion including a cylindrical side wall protruding outwardly from the cartridge body in the prescribed direction, the cylindrical side wall having a base end and a protruding end opposite to each other in the prescribed direction, the cylindrical side wall defining therein an inner space of the print fluid supply portion, the print fluid supply portion being integrated with the cartridge body at the base end of the cylindrical side wall such that the inner space of the print fluid supply portion is in fluid communication with an inside of the reservoir, the print fluid supply portion further including a protruding-end wall disposed at the protruding end of the cylindrical side wall, the protruding-end wall extending inwardly from the cylindrical side wall in a direction intersecting with the prescribed direction, the protruding-end wall having an inner peripheral edge defining a protruding-end opening;

a tubular member, at least a portion of which is disposed in the inner space of the print fluid supply portion with a gap being formed between an inner surface of the cylindrical side wall and an outer surface of a portion of the tubular member disposed in the inner space of the print fluid supply portion, the tubular member extending in the prescribed direction and having a first end and a second end opposite to each other in the prescribed direction, the first end being disposed nearer to the protruding-end wall than the second end to the protruding-end wall in the prescribed direction, the tubular member being opened at both of the first end and the second end;

an elastic member provided in the inner space of the print fluid supply portion, the elastic member being disposed between the first end of the tubular member and the protruding-end wall of the print fluid supply portion, the elastic member being formed with a through-hole through which the protruding-end opening is in fluid communication with an inside of the tubular member, the elastic member having an outer peripheral portion, the outer peripheral portion having a first surface and a second surface, the first surface facing in the prescribed direction and surrounding an entire periphery of the through-hole, the second surface facing in a direction opposite to the prescribed direction and surrounding the entire periphery of the through-hole, the first surface being in contact with a portion of the protruding-end wall that surrounds an entire periphery of the protruding-end opening, the second surface being in contact with the first end of the tubular member;

a lid body disposed in the inside of the tubular member and configured to move between a first position, at which the lid body closes the through-hole of the elastic member, and a second position, at which the lid body opens the through-hole of the elastic member, the first and second positions being separate from each other in the prescribed direction; and an urging member disposed in the inside of the tubular member and configured to urge the lid body in a direction toward the first position, the cartridge accommodating section including a print fluid supplying tube that is configured to enter the through-hole of the elastic member and press the lid body to allow print fluid in the reservoir to flow out of the print fluid cartridge, the print fluid supplying tube being configured to move the lid body from the first position to the second position against an urging force of the urging member.

14. The print fluid supplying apparatus according to claim 13, wherein the protruding-end wall of the print fluid supply portion is provided with a ridge on a surface of the protruding-end wall facing the elastic member, the ridge protruding from the surface of the protruding-end wall in a direction toward the elastic member, the ridge extending continuously around the protruding-end opening along a closed path that surrounds the entire periphery of the protruding-end opening, the first surface of the elastic member being in contact with an area of the protruding-end wall within which the ridge is provided.

15. A cartridge comprising:

a main body having one end;

an ink supply portion extending in a prescribed direction away from the one end, the ink supply portion including:

a cylindrical side wall extending in the prescribed direction and having a base end and a distal end opposite to each other in the prescribed direction, the base end of the cylindrical side wall being integrated with the one end of the main body, the cylindrical side wall defining therein an internal space of the ink supply portion; and a distal end wall provided on the distal end of the cylindrical side wall, the distal end wall facing in the prescribed direction and being formed with an opening that is in fluid communication with the internal space of the ink supply portion;

a tubular member, at least a portion of which is disposed in the internal space of the ink supply portion, the tubular member extending in the prescribed direction and having a first end and a second end opposite to each other in the prescribed direction, the first end being disposed nearer to the distal end of the cylindrical side wall than the second end to the distal end of the cylindrical side wall in the prescribed direction, the first end of the tubular member being formed with an opening;

an elastic member disposed in the internal space of the ink supply portion at a position between the distal end wall and the first end of the tubular member, the elastic member being formed with a through-hole through which the opening of the distal end wall is in fluid communication with the opening of the first end of the tubular member; and a lid body configured to open and close the through-hole of the elastic member.

16. The cartridge according to claim 15, wherein the distal end wall is formed with a ridge protruding in a direction toward the elastic member, the ridge being in contact with a portion of the elastic member that surrounds an entire periphery of the through-hole of the elastic member.

17. The cartridge according to claim 16, wherein the first end of the tubular member and the ridge on the distal end wall confront with each other in the prescribed direction with the elastic member being sandwiched therebetween.

18. The cartridge according to claim 15, wherein the tubular member is disposed relative to the ink supply portion such that a gap is formed in the internal space of the ink supply portion between the tubular member and the cylindrical side wall.

19. The cartridge according to claim 15, further comprising a spring disposed inside the tubular member and configured to urge the lid body in the prescribed direction so that the lid body closes the through-hole of the elastic member.

* * * * *